US006572716B2

(12) United States Patent
Hayashi et al.

(10) Patent No.: US 6,572,716 B2
(45) Date of Patent: Jun. 3, 2003

(54) FINE FERRITE-BASED STRUCTURE STEEL PRODUCTION METHOD

(75) Inventors: Tohru Hayashi, Ibaraki (JP); Shiro Torizuka, Ibaraki (JP); Kaneaki Tsuzaki, Ibaraki (JP); Kotobu Nagai, Ibaraki (JP); Osamu Umezawa, Ibaraki (JP)

(73) Assignee: National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/157,393

(22) Filed: Sep. 21, 1998

(65) Prior Publication Data

US 2002/0014285 A1 Feb. 7, 2002

(30) Foreign Application Priority Data

Sep. 22, 1997 (JP) ..... 09-256486
Mar. 4, 1998 (JP) ..... 10-052557

(51) Int. Cl.[7] ..... C21D 7/00

(52) U.S. Cl. ..... 148/648

(58) Field of Search ..... 148/320, 321, 148/322, 323, 324, 325, 326, 327, 328, 648

(56) References Cited

U.S. PATENT DOCUMENTS

| | | | | | |
|---|---|---|---|---|---|
| 3,755,004 | A | * | 8/1973 | Miller | 148/620 |
| 4,466,842 | A | * | 8/1984 | Yada et al. | 148/564 |
| 4,578,124 | A | * | 3/1986 | Yutori et al. | 148/598 |
| 4,776,900 | A | * | 10/1988 | Yano et al. | 148/653 |
| 4,826,543 | A | * | 5/1989 | Yano et al. | 148/653 |
| 4,946,516 | A | * | 8/1990 | Yano et al. | 148/547 |
| 5,454,887 | A | * | 10/1995 | Fukui | 148/603 |
| 5,634,988 | A | * | 6/1997 | Kurebayashi et al. | 148/320 |
| 5,653,826 | A | * | 8/1997 | Koo et al. | 148/328 |
| 5,858,130 | A | * | 1/1999 | Bodnar et al. | 148/332 |
| 5,900,075 | A | * | 5/1999 | Koo et al. | 148/328 |
| 6,221,178 | B1 | * | 4/2001 | Torizuka et al. | 148/320 |

FOREIGN PATENT DOCUMENTS

| | | | | |
|---|---|---|---|---|
| JP | 58157948 | * | 9/1983 | |
| JP | 02-301540 A | * | 12/1990 | C22C/38/00 |
| JP | 10053837 | * | 2/1998 | |

* cited by examiner

*Primary Examiner*—Roy King
*Assistant Examiner*—Harry D. Wilkins, III
(74) *Attorney, Agent, or Firm*—Wenderoth, Lind & Ponack, L.L.P.

(57) ABSTRACT

A fine ferrite-based steel is disclosed, wherein at least 60% of the ferrite grain boundary is a large angle grain boundary of at least 15°, and the mean ferrite grain size is not more than 2.5 $\mu$m. The fine ferrite-based steel of the invention has a high strength and a long fatigue life.

5 Claims, 2 Drawing Sheets

FINE FERRITE-BASED STRUCTURE STEEL PRODUCTION METHOD

FIELD OF THE INVENTION

The present invention relates to a fine ferrite-based steel and a production method thereof. More specifically, the present invention relates to a fine ferrite-based steel which is a ferrite-based steel used in various forms such as steel bar, steel section, steel sheet, and steel plate as texture steels, etc., and has a high strength and a long fatigue life, and to a production method thereof.

BACKGROUND OF THE INVENTION

Hitherto, as a strengthening method of a stool material, a solid solution strengthening method, a strengthening method by a secondary phase by forming a composite with martensite, etc., a deposition strengthening method, and a strengthening method by fining the crystal grains are known. Among these methods, as a method of increasing both the strength and the toughness and improving the strength•ductility balance, the method of strengthening by fining the crystal grains is the most excellent method. Because the method does not require the addition of an expensive element such as Ni, Cr, etc., for increasing the hardenability, it is considered the production of a high-strength steel material at a low cost is possible. From the view point of fining the crystal grains, it is expected that when in a texture steel, the grain sizes of the crystals of martensite are fined to 2.5 μm or smaller, the strength is suddenly increased. However, in the grain sizes of about 5 μm obtained by a conventional thermo-mechanical treatment technique, it is the present state that though a high strength is obtained, a large increase of the strength has not yet been obtained.

On the other hand, a controlled rolling•accelerating cooling technique was an effective method for obtaining fine ferrite. That is, by controlling the accumulated deformation in the austenite unrecrystallization region and the cooling rate after that, a fine structure has been obtained. However, the limit of the ferrite grain size obtained was at most 10 μm in an Si—Mn steel and 5 μm in an Nb steel. On the other hand, as described in Japanese Patent Laid open Nos. 5-123823 and 59-205447, Japanese Patent Publication Nos. 62-39228, 62-5212, and 62-7247, it is reported that in the case of applying a reduction of at least 75% of the total area-reduction ratio in the temperature range of $Ar_1$ to $Ar_3$+100° C. including a 2-phase region and thereafter cooling 20 K/s or higher, ferrite grains of from about 3 to 4 μm are obtained. However, quenching of 20 K/s or higher is a means which can be realized only when the thickness of a steel sheet is thin and is only a non-practical means which cannot be widely realized as a production method of conventional welding steels. Also, about the large deformation itself, in rolling, it is generally difficult to carry out a large reduction exceeding 50% by one pass in an austenite low-temperature region against the deformation resistance and the gripping restriction of a roll. Also, for the accumulation reduction in an unrecrystallized region, 70% or higher is generally necessary and it is difficult by temperature lowering of a steel sheet.

Also, on the other hand, in "Tekko No Kesshoryu Chobisaika (Super Fining of Crystal Grains of Iron and Steel)", edited by The Iron and Steel Institute of Japan (1991), page 41, by changing the view point, by recrystallizing a bainite structure, a fine ferrite texture is obtained. However, even if the components optimization is achieved, the recrystallization temperature cannot be lowered and the growth of the ferrite grains is not lowered, and the ferrite grain size of less than 5 μm is not obtained.

SUMMARY OF THE INVENTION

Thus, an object of the present invention is to overcome the limits of conventional techniques as described above and to provide a novel steel having a ultra-fine ferrite structure of 2.5 μm or less, which has never been known, for far largely increasing the strength thereof and having excellent characteristics such as the greatly long fatigue life, etc.

It has now been found that the object described above has been achieved by the present invention as set forth hereinbelow.

That is, a first aspect of the present invention is to provide a fine ferrite-based steel comprising a ferrite-based steel obtained by work-induced recrystallizing from a martensite steel after heating to a temperature of from 500° C. to $Ac_1$, wherein the mean ferrite grain size is not larger than 2.5 μm.

A second aspect of the present invention is to provide a fine ferrite-based steal of the first aspect wherein the martensite steel is a steel obtained by heating a steel material to a temperature range of from $Ac_3$ to 1,350° C. and quenching from an austenite region after working or without working.

A third aspect of the present invention is to provide a fine ferrite-based steel of the first or second aspect wherein the work-induced recrystallization is carried out by working of a reduction ratio of at least 50%.

A fourth aspect of the present invention is to provide a fine ferrite-based steel of first to third aspects wherein the martensite steel is obtained from a steel material containing, as the chemical composition:

C. 0.001 to 0.80 mass %,

Si: not more than 0.80 mass %,

Mn: 0.8 to 3.0 mass %, and

Al: not more than 0.10 mass %, with the rest being Fe and unavoidable impurities.

A fifth aspect of the present invention is to provide a fine ferrite-based steel of the fourth aspect wherein the martensite steel is obtained from the steel material further containing at least one kind of:

Cu: 0.05 to 2.5 mass %,

Ni: 0.05 to 3 mass %,

Ti: 0.005 to 0.1 mass %,

Nb: 0.005 to 0.1 mass %,

V: 0.005 to 0.1 mass %,

Cr: 0.01 to 3 mass %,

Mo: 0.01 to 1 mass %,

W: 0.01 to 0.5 mass %,

Ca: 0.001 to 0.01 mass %,

REM: 0.001 to 0.02 mass %, and

B: 0.0001 to 0.006 mass %, in addition to the compositions described in the fourth aspect.

A sixth aspect of the present invention is to provide a fine ferrite-based steel, characterized in that the steel has a fine ferrite structure wherein at least 60% of the ferrite grain boundary is a large angle grain boundary of at least 15°, and the mean grain size is not larger than 5 μm.

A seventh aspect of the present invention is to provide a production method of a fine ferrite-based steel, which comprises working a steel material capable of forming a ferrite phase by working to cause recover and recrystallization and producing a fine ferrite-based steel having a fine ferrite structure wherein at least 60% of the ferrite grain boundary is a large angle grain boundary of at least 15° and the mean grain size is not larger than 5 μm.

An eighth aspect of the present invention is to provide a production method of a fine ferrite-based steel of the seventh aspect wherein the steel material is worked at 50% or more by the total working amount.

A ninth aspect of the present invention is to provide a production method of a fine ferrite-based steel of the seventh or eighth aspect wherein working is carried out by at least two passes and in the at least optional two passes, the reducing direction or the rolling direction differs from each other.

A tenth aspect of the present invention is to provide a production method of a fine ferrite-based steel of the ninth aspect wherein in the at least optional two passes, each total reduction ratio or total rolling ratio is at least 29%.

An eleventh aspect of the present invention provides a production method of a fine ferrite-based steel of the seventh to tenth aspects wherein the structure before working is martensite or annealed martensite.

DETAILED DESCRIPTION OF THE INVENTION

Figure 1:
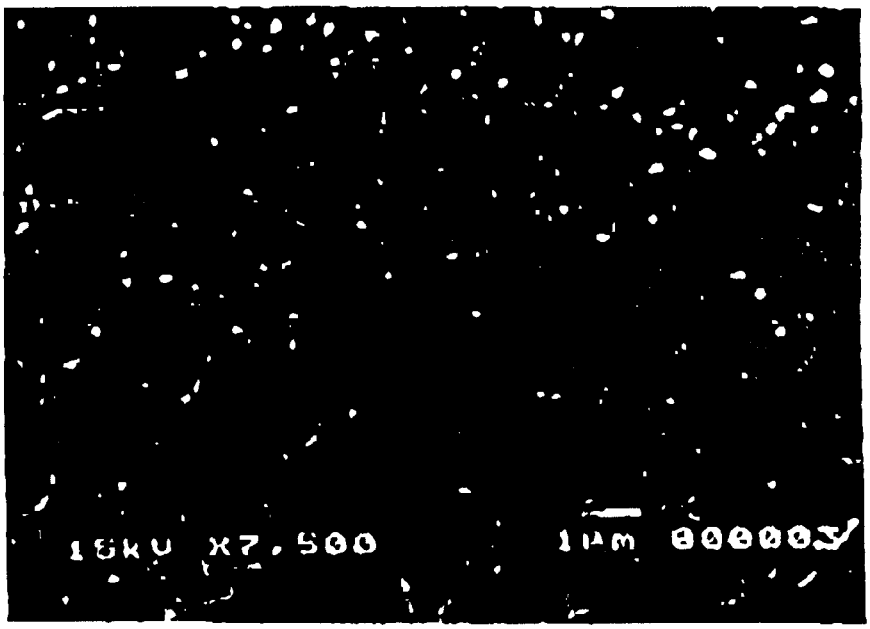
FIG. 1 is an electron micrograph (SEM) showing the observed structure of the sample of the example of the present invention.

Then, the present invention is described in detail.

The present invention has the features as described above, and the invention is based on the discovery that by forming many ferrite recrystallized nuclei at a low temperature and recrystallizing them, a steel material having a mean ferrite crystal grain size of not larger than 2.5 μm can be produced.

That is, to recrystallize at a low temperature, the structure before working is made martensite containing deposits and after re-heating to and maintaining at the recrystallization temperature, the martensite is worked and maintained at a constant temperature to cause a work-induced recrystallization. Technically, following matters are important.

1) Formation of Martensite of the Structure Before Working:

The inside of martensite is divided into line packets or blocks. Because the boundaries of these packets or blocks become the recrystallizing sites, the formation of the fine ferrite structure is possible. Also, because martensite has a high strain energy to ferrite•pearlite or bainite, martensite is liable to be recrystallized, and the recrystallization temperature can be lowered.

2) Precipitation Before Working:

By precipitating before working, it becomes possible to introduce non-uniform strains near the precipitates by working. Because the recrystallization occurs in the presence of the distribution of non-uniform strains, the precipitate before working is indispensable.

3) Working:

When working is at least 50%, it is desirable that working is applied at or lower than a recrystallization temperature. Working is a means for giving further energy to the material for the recrystallization thereof. By working of less than 50%, the recrystallization is hard to occur. In this case, when multi-axis working is applied, the recrystallized grain azimuthal angles become random, which is more effective.

4) After Working, Maintaining at recrystallization Temperature:

After working, by maintaining the texture at the recrystallization temperature, the texture is recrystallized. The maintaining time depends upon the composition of the steel, the worked amount, etc., but it is necessary to maintain for longer than the time of recrystallizing at least 80%. However, maintaining for a long time after completing the recrystallization is not preferred because of causing a coarse structure.

In view of the above-described knowledge, the present invention has the above-described constitution as essential factors, and the more practical production method of the present invention is as follows.

That is, first, a steel material is heated to a temperature range of from $Ac_3$ to 1,350° C. and quenched in the austenite range after working or without working such that the structure becomes martensite. After re-heating the steel to a temperature of from 500° C. to $Ac_1$, the steel is maintained for from 1 to 1000 seconds, immediately thereafter, working of at least 50% is carried out, and after maintaining at the temperature for at least 10 seconds, the steel is cooled. Thus, a fine ferrite steel having a mean ferrite grain size of not larger than 2.5 μm is obtained.

The reason that the heating temperature is properly from $Ac_3$ to 1,350° C. is to make the structure austenite temporarily. By working in the austenite region, austenite grains are fined and with fining the grains, packets and blocks are inevitably fines, and recrystallized sites are increased. In this case, working is not always necessary but it is preferred to carry out working. Cooling differs according to the components of the steel, but to make the structure before working martensite, it is proper that the steel is quenched at a cooling rate of at least about 10° C./second. By making the structure before working martensite, it is possible that the subsequent recrystallization temperature can be lowered than the case the structure before working is other than martensite.

It is suitable, then, after re-heating to a temperature range of from 500° C. to $Ac_1$, the steel is hold for from 1 to 3,600 seconds, and after working of at least 50%, the steel is hold at the temperature for 10 seconds or longer. To cause a recrystallization, it is necessary that the temperature is 500° C. or higher, but when the temperature exceeds $Ac_1$, austenite is formed, therefore, it is preferred that the re-heating temperature if from 500° C. to $Ac_1$. The holding time is desirably 1 second or longer for precipitating but when the holding time exceeds 3,600 seconds, since the recrystallization at low temperature is hard to occur by the recover of the dislocation in the martensite structure, it is proper that the holding time is from 1 to 3,600 seconds. Also, when the working amount is not at least 50%, since the recrystallization cannot occurred, the working amount is defined to be at least 50%. It is preferred to control the growth of the crystal grains that after completing the recrystallization, the steel formed is cooled as quick as possible.

There is no particular restriction on the chemical composition of the steel material, but the composition described above is employed, the following matters are considered.

C: 0.001 to 0.80 mass %

It is desirable for ensuring the strength, precipitating such as $Fe_3C$, etc., and formation of martensite that the content of C is 0.001 mass % or higher. However, when C is added in a content exceeding 0.80 mass %, the toughness is greatly reduced, and thus, it is proper that the addition range of C is from 0.001 to 0.80 mass %.

Si: Not more than 0.80 mass %

When Si is added exceeding 0.80 mass %, since the weldability is reduced, it is proper that the addition range of Si is not more than 0.80 mass %.

Mn: 0.8 to 3.0 mass %

It is desirable for making the structure martensite temporarily that the content of Mn is 0.8 mass % or higher. However, when more than 3.0 mass % Mn is added, since the weldability is greatly deteriorated, it is proper that the addition range of Mn is from 0.8 to 3.0 mass %.

Al: Not more than 0.10 mass %

When Al is added exceeding 0.10 mass %, since the cleanness of the steel is deteriorated, it is preferred that the addition range of Al is not more than 0.10 mass %.

Cu: 0.05 to 2.5 mass %

The addition of 0.05 mass % or more Cu is effective for increasing the strength by strengthening the precipitation and strengthening the solid solution, but when Cu is added exceeding 2.5 mass %, since the weldability is deteriorated, the addition range of Cu is defined to be from 0.05 to 2.5 mass %.

Ni: 0.05 to 3 mass %

The addition of 0.05 mass % or more Ni is effective for increasing the strength and making the texture martensite temporarily, but when Ni is added exceeding 3 mass %, since the effect of increasing the strength is less, it is preferred that the addition range of Hi is from 0.05 to 3 mass %.

Ti: 0.005 to 0.1 mass %

The addition of 0.005 mass % or more Ti has the effects of accelerating the work-induced recrystallization by the precipitation of Ti (C, N) and restraining the growth of the recrystallized grains, but when Ti is added exceeding 0.1 mass %, since the effects are saturated, the addition range of Ti is preferably defined to be from 0.05 to 0.1 mass %.

Nb: 0.005 to 0.1 mass %

The addition of 0.005 mass % or more Nb has the effects of accelerating the work-induced recrystallization by the precipitation of Nb (C, N) and restraining the growth of the recrystallized grains, but when Nb is added exceeding 0.1 mass %, since the effects are saturated, the addition range of Nb is properly defined to be from 0.005 to 0.1 mass %.

V: 0.005 to 0.1 mass %

The addition of 0.005 mass % or more V has the effects of accelerating the work-induced recrystallization by the precipitation of V (C, N) and restraining the growth of the recrystallized grains, but when V is added exceeding 0.1 mass %, since the effects are saturated, the addition range of V is properly defined to be from 0.005 to 0.1 mass %.

Cr: 0.01 to 3 mass %

The addition of 0.01 mass % or more Cr has the effects of accelerating the work-induced recrystallization by the precipitation of carbides and restraining the growth of the recrystallized grains, but when Cr is added exceeding 3 mass %, since the effects are saturated, the addition range of Cr is properly defined to be from 0.01 to 3 mass %.

Mo: 0.01 to 1 mass %

The addition of 0.01 mass % or more Mo has the effects of accelerating the work-induced recrystallization by the precipitation of carbides and restraining the growth of the recrystallized grains, but when Mo is added exceeding 1 mass %, since the effects are saturated, the addition range of Mo is properly defined to be from 0.01 to 1 mass %.

W: 0.01 to 0.5 mass %

The addition of 0.01 mass % or more W has the effect of increasing the strength, but when W is added exceeding 0.5 mass %, since the toughness is deteriorated, the addition range of W is preferably defined to be from 0.01 to 0.5 mass %.

Ca: 0.001 to 0.01 mass %

The addition of 0.001 mass % or more Ca has the effect of controlling the form of sulfide-based inclusions, but when Ca is added exceeding 0.01 mass %, since inclusions are formed in the steel to deteriorate the properties of the steel, the addition amount of Ca is properly from 0.001 to 0.01 mass %.

REM: 0.001 to 0.02 mass %

The addition of 0.001 mass % or more REM has the effect of restraining the growth of the austenite grains and fining the austenite grains, but when REM is added exceeding 0.02 mass %, since the cleanness of the steel is reduced, the addition amount of REM is properly defined to be from 0.001 to 0.02 mass %.

B: 0.0001 to 0.006 mass %

The addition of 0.0001 mass % or more B has the effects of greatly increasing the hardenability of the steel and temporarily forming martensite, but when B is added exceeding 0.006 mass %, since B compounds are formed to deteriorate the toughness, the addition amount of B is properly defined to be from 0.0001 to 0.006 mass %.

In addition, in the present invention, the steel of the present invention is defined to be a ferrite-based steel, and the term "based" includes not only a ferrite single phase, but also from a structure mainly composed of a ferrite phase to a structure like the single phase as near as possible. For example, as the volume ratio, it means that the ferrite phase is at least 50%, further at least 70%, and still further at least 90%. As the matter of course, it includes the ferrite single phase of the volume ratio of 100%.

Furthermore, in the fine ferrite-based steel of the present invention, at least 60% of the ferrite grain boundary may be a large angle grain boundary of at least 15°, and the steel has a ferrite structure having a mean grain size of not larger than 5 $\mu$m. That is, in the present invention, the ferrite grain size is fine as not larger than 5 $\mu$m, whereby the strength of the steel is increased, and the fatigue life of the steel is prolonged. Moreover, because in the present invention, at least 60% of the ferrite grain boundary is a large angle grain boundary having the azimuthal angle of the crystals constituting the grain boundary each other of at least 15°, the strength and the fatigue life of the steel are more improved.

Working is a means of giving an energy of recovering and recrystallizing the steel material and is accompanied by a compressive deformation of the steel material. The working is carried out at the temperature range of $AC_1$ or lower. The working can be carried out by cold-working, and in this case, the working can be carried out at room temperature. In this case, it is preferred that the total worked amount is 50% of more. When the worked amount is less than 50%, the ferrite dislocation density is hard to lower to $1\times10^9$ $cm^{-2}$ or lower, and ferrite is hard to be formed.

Also, when working is multi-passes of at least two passes and in the passes, in the at least optional two passes, reduction directions or rolling reductions are different from each other, the ferrite grains finally obtained by the recovery-•recrystallization are liable to direct to different crystal azimuthes each other. Also, in the ferrite grain boundary of at least 60%, a large crystal grain boundary of at least 15° is effectively formed. More preferably, at least optionally two passes are carried out such that each of the total reduction ratios or the total rolling ratios becomes at least 29%.

After working, generally, annealing of the worked texture is carried out, whereby the recrystallization can be carried out. In addition, according to the components of the steel, the worked amount, and the working temperature, the reduction•recrystallization occur by working only, as the case may be, the ferrite structure having the ferrite dislocation density of $1\times10^9$ $cm^{-2}$ or lower is formed, and in such a case, annealing is not always necessary. On the other hand, when cold-rolling is carried out, annealing is inevitable.

The annealing temperature is preferably in the temperature range of from 500° C. to $Ac_1$. When the working and annealing temperature exceeds $Ac_1$, austenite is formed. On the other hand, if the temperature is lower than 500° C., it is difficult to lower the ferrite dislocation density to $1\times10^9$ $cm^{-2}$ or lower. The holding time depends upon the steel composition, the worked amount, etc., but is preferably longer than the time that the dislocation density of ferrite becomes $1\times10^9$ $cm^{-2}$ or lower. However, maintaining of a long time after completing the recrystallization is undesirable because of causing the formation of a coarse structure.

More practical production method of a fine ferrite-based steel of the present invention is shown below.

First, a steel material is heated in the temperature range of from $Ac_3$ (the temperature of finishing the transformation of austenite) to 1,350° C. and after cooling in the austenite region after working or without working, the steel material is quenched such that the structure becomes martensite. When working is carried out in the austenite region, austenite grains are fined, whereby packets or blocks are also fined to increase the recrystallized sites. Quenching differs according to the components of the steel but is preferably a cooling rate of about 10° C./second or higher. Also, by making the structure before working martensite, the recrystallization temperature can be lowered to a temperature lower than the annealing temperature of the case that the texture before working is other than martensite.

Then, after re-heating the steel material to a temperature range of from 500° C. to $Ac_1$, the steel material is maintained for from 1 to 3,600 seconds (preferably from 1 to 1,000 seconds), immediately working of at least 50% is carried out, and immediately thereafter, the steel material is quenched or the steel material is hold at the temperature range for at least 10 seconds and cooled. It is preferred for restraining the growth of the crystal grains to cool as quickly as possible after finishing the recrystallization.

Thus, a fine ferrite-based steel wherein at least 60% of the ferrite grain boundary is a large crystal grain boundary of at least 15°, and the mean ferrite grain size of not larger than 5 μm is obtained.

Then, the following Examples are intended to illustrate the present invention in more detail but not to limit the invention in any way.

EXAMPLES 1 AND 2 AND COMPARATIVE EXAMPLES 1 TO 6

To a test piece having a composition of 0.05 wt. % C, 2.0 wt. % Mn, and 0.035 wt. % Al, with the rest being Fe and unavoidable impurities, was applied the thermo-mechanical treatment shown in Table 1, and the ferrite crystal grain sizes were measured. As the working means, the means by an anvil compression-type test machine and a swaging means capable of carrying out a casting work from the whole directions were used. As a result, the recrytallization ratios and each of the mean ferrite grain size (μm) are shown in Table 2 below. Also, the microstructure of the steel of the example of the present invention is shown in FIG. 1.

Each of the steels of the Examples of the present invention shows a fine ferrite structure having a mean grain size of 2.5 μm or smaller. As is clear from the comparison of the Examples and the Comparative Examples, it can be seen that by making the structure before working martensite, the steel is easily recrystallized, and when the treatment or completely finishing the recrystallization is carried out, in the case that the structure before working is martensite, the recrystallized ferrite grain sizes are smaller.

TABLE 1

| | Pretreatment | | | Recrystallization thermo-mechanical treatment | | | | | |
|---|---|---|---|---|---|---|---|---|---|
| No. | Heating temperature (° C.) | Cooling rate (° C./sec.) | Structure after cooling | Re-heating temperature (° C.) | Holding time before working (sec.) | Working means | Worked amount (%) | Holding time after working (sec.) | Cooling rate after maintained (° C.) |
| Example 1 | 1100 | 100 | Martensite | 640 | 10 | Anvil compressive work | 50 | 600 | 10 |
| Example 2 | 1100 | 100 | Martensite | 640 | 60 | Swaging | 50 | 200 | 10 |
| Comparative Example 1 | 1100 | 100 | Martensite | 640 | 10 | Anvil compressive work | 20 | 600 | 10 |
| Comparative Example 2 | 1100 | 20 | Bainite.ferrite | 640 | 10 | Anvil compressive work | 50 | 600 | 10 |
| Comparative Example 3 | 1100 | 1 | Ferrite.pearlite | 640 | 10 | Anvil compressive work | 50 | 600 | 10 |
| Comparative Example 4 | 1100 | 1 | Ferrite.pearlite | 640 | 10 | Anvil compressive work | 50 | 1150 | 10 |
| Comparative Example 5 | 1100 | 1 | Ferrite.pearlite | 640 | 10 | Anvil compressive work | 50 | 1500 | 10 |
| Comparative Example 6 | 1100 | 1 | Ferrite.pearlite | 640 | 10 | Anvil compressive work | 50 | 3600 | 10 |

TABLE 2

| | Texture | | Mechanical Properties | |
|---|---|---|---|---|
| No. | Re-crystallization ratio** (%) | Mean ferrite grain size (μm) | Hardness (Hv) | Fatigue strength (MPa) |
| Example 1 | 100 | 1.2 | 181 | 482 |
| Example 2 | 100 | 1.0 | 236 | 517 |
| Comparative Example 1 | 0 | — | — | — |
| Comparative Example 2 | 10 | 1.2* | — | — |
| Comparative Example 3 | 5 | 1.2* | — | — |

TABLE 2-continued

| No. | Texture | | Mechanical Properties | |
|---|---|---|---|---|
| | Re-crystallization ratio** (%) | Mean ferrite grain size (μm) | Hardness (Hv) | Fatigue strength (MPa) |
| Comparative Example 4 | 100 | 3.0 | 162 | 350 |
| Comparative Example 5 | 100 | 10.0 | 153 | 246 |
| Comparative Example 6 | 100 | 25.0 | 131 | 200 |

*Recrystallization unfinished. The value of the recrystallized portion only was shown. When maintained until the recrystallization is finished, the mean ferrite grain size becomes more larger.
**Defined to be a 100-martensite volume ratio (%).

EXAMPLE 3

After maintaining an Fe-0.05 mass % C-2.0 mass % Mn steel for 60 second at 1,100° C., the steel was cooled with water to form a martensite structure. Then, the steel was re-heated to 640° C., and after two pass-working during warm, the steel was cooled. Also, after, similarly, two pass-working during warm, the steel was annealed for 200 seconds and cooled.

In the work, 50% roll rolling after holding the steel for 300 seconds at 640° C. was the first pass and the 50% plane strain compression was the second pass. Between the two passes, the rolling direction (RD) was changed.

Figure 2:
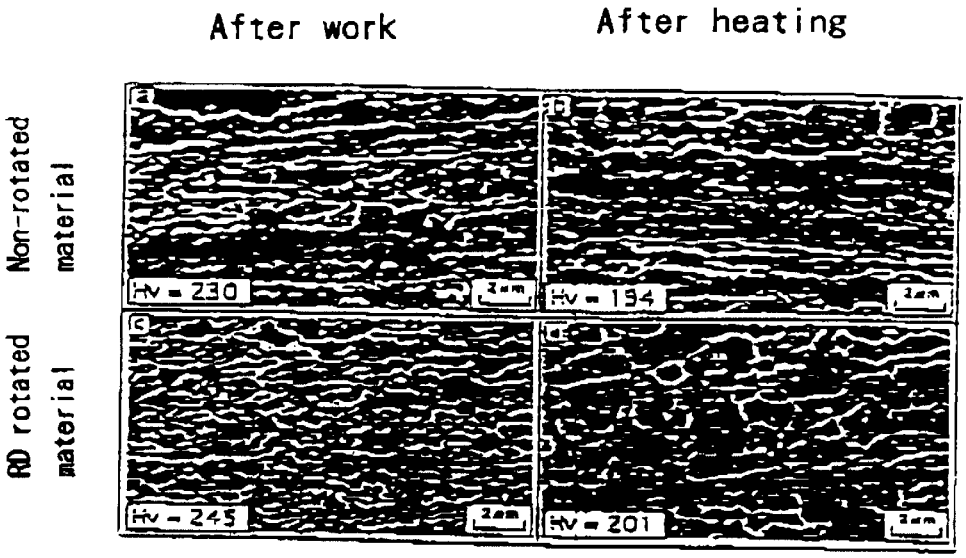
FIG. 2 is an electron micrograph showing the ferrite structure after working and annealing an Fe-0.05% C-2.0% Mn steel together with the hardness by a, b, c, and d, respectively.

The microstructure and the hardness (Hv) of the steel are as shown in FIG. 2. The steels wherein the RD is changed are non-rotated materials (a and b of FIG. 2) and the steels wherein the RD was rotated at 90° are RD rotated materials (c and d of FIG. 2). In each of the RD rotated materials, at least 60% of the ferrite grain boundary was a large angle grain boundary of at least 15°, the mean ferrite grain size became a fine equip-axed grain of not larger than 2.5 μm, and a fine ferrite-based structure was formed. Also, the hardness (strength) was further improved as compared with those of the non-rotated materials.

As a matter of course, the present invention is not limited by these Examples. That is, various modifications are possible about the chemical compositions of the materials, the working and annealing conditions, etc., in the present invention.

As described above in detail, according to the present invention, the steel of a fine ferrite structure having a mean ferrite grain size of not larger than 2.5 μm, which has never been realized by conventional techniques, is provided.

Also, according to the present invention, a ferrite steel having a high strength and a long fatigue life is provided, and the ferrite steel of the present invention is useful for steel bars, steel sections, thin sheets, and thick sheets.

What is claimed is:

1. A production method of a fine ferrite-based steel, which comprises working a steel material having a martensite or annealed martensite structure and being capable of forming a ferrite phase by working to cause recover and recrystallization and producing a fine ferrite-based steel having a fine ferrite structure wherein at least 60% of the ferrite grain boundary is a large crystal grain boundary of at least 150 and the mean grain size is not larger than 5 μm.

2. A production method of a fine ferrite-based steel of claim 1, wherein the steel material is worked at 50% or more as the total working amount.

3. A production method of a fine ferrite-based steel of claim 1 or 2, wherein working is carried out by two or more passes and in at least two of the passes, the reducing direction or the rolling direction differs from each other.

4. A production method of a fine ferrite-based steel of claim 3, wherein in the at least two passes, each total reduction ratio or total rolling ratio is at least 29%.

5. A production method of a fine ferrite-based steel, which comprises working a steel material which is capable of forming a ferrite phase by working in a temperature range of $Ac_1$ or lower to cause recover and recrystallization, and producing a fine ferrite-based steel having a fine ferrite structure wherein at least 60% of the ferrite grain boundary is a large crystal grain boundary of at least 150 and the mean grain size is not larger than 1.2 μm.

* * * * *